United States Patent [19]

Pessier

[11] 4,316,515

[45] Feb. 23, 1982

[54] SHAFT DRILL BIT WITH IMPROVED CUTTER BEARING AND SEAL ARRANGEMENT AND CUTTER INSERT ARRANGEMENT

[75] Inventor: Rudolph C. O. Pessier, West University Place, Tex.

[73] Assignee: Hughes Tool Company, Houston, Tex.

[21] Appl. No.: 43,533

[22] Filed: May 29, 1979

[51] Int. Cl.[3] ..... E21B 10/22

[52] U.S. Cl. ..... 175/372; 175/344; 175/376; 175/378; 175/53

[58] Field of Search ..... 175/53, 361–364, 175/372, 371, 344–347, 376, 378

[56] References Cited

U.S. PATENT DOCUMENTS

| | | | |
|---|---|---|---|
| 3,601,207 | 8/1971 | Coski et al. | 175/364 |
| 3,726,350 | 4/1973 | Pessier | 175/376 X |
| 3,797,592 | 3/1974 | Goodfellow | 175/346 |
| 4,187,922 | 2/1980 | Phelps | 175/376 |

*Primary Examiner*—William F. Pate, III

*Attorney, Agent, or Firm*—Robert A. Felsman

[57] ABSTRACT

An earth boring drill bit, particularly for large diameter shafts, has a cutter assembly with improved bearing and seal arrangement and an improved cutting insert arrangement. A cutter assembly has an axle with an enlarged central portion and reduced portions on both sides. A cutter sleeve is carried on bearings by the central portion of the axle. An annular member with a central bore is secured to each side of the cutter sleeve. A metal face seal is secured between the reduced portion and the central bore on each side. The cutter contains rows of hard metal inserts secured in holes in the exterior. To reduce tracking, the inserts within a row are separable into groups with varied pitch within each group. The groups cycle with two groups having a gradual increase in pitch and two groups having decreasing pitch.

18 Claims, 8 Drawing Figures

Fig. 2
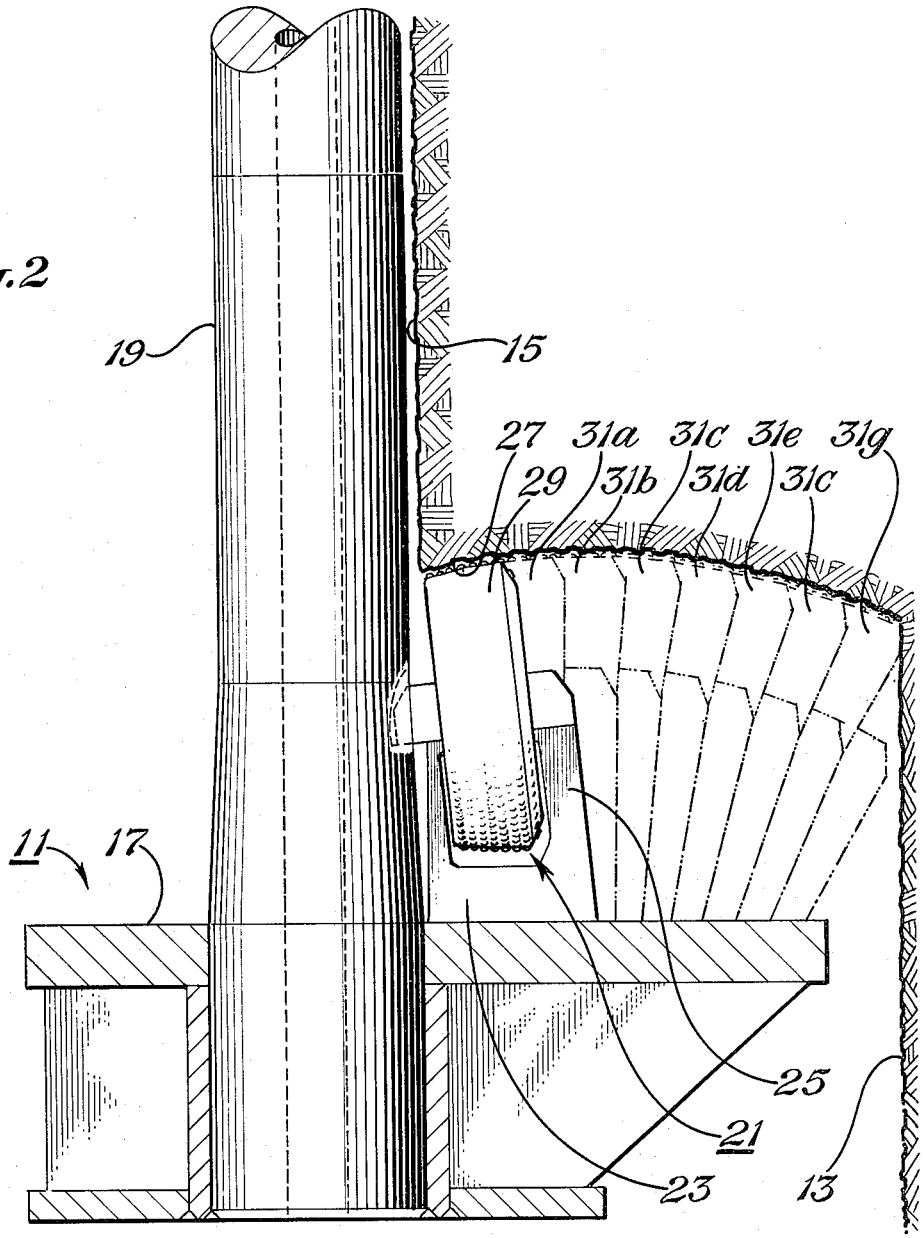
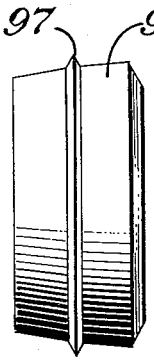
Fig. 3
Fig. 4
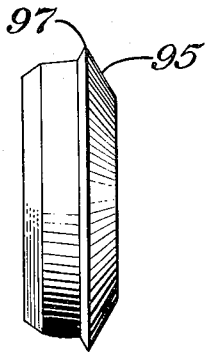

SHAFT DRILL BIT WITH IMPROVED CUTTER BEARING AND SEAL ARRANGEMENT AND CUTTER INSERT ARRANGEMENT

BACKGROUND OF THE INVENTION

1. Field of the Invention

This invention relates in general to earth boring drill bits, and in particular to the cutter bearing and seal arrangement, and to the insert arrangement of a large diameter shaft bit.

2. Description of the Prior Art

Drill bits for large diameter shafts normally have a cutter support plate that is connected to a string of drill pipe for rotation. A number of cutter assemblies are rotatably secured to the cutter support plate to disintegrate the earth as the cutter support plate is rotated. Drilling may be downward, or upward by pulling the bit through a pilot hole, as in raise drilling.

Each cutter assembly includes an axle for securing to a cutter mount attached to the cutter support plate. A cutter sleeve is mounted on the axle by roller bearings, with the ends of the axle extending beyond each side of the sleeve. A seal is located on each side of the sleeve between the axle and the sleeve to prevent grit from entering the bearings. Typical types are shown in U.S. Pat. Nos. 3,612,196 and 3,216,513. In these patents and in all other types known to applicant, the seals are equal or slightly larger in diameter than the bearings.

One disadvantage of having large diameter seals is that the surface velocity between the moving parts is higher and generates more heat than would occur if the seal were a smaller diameter. Any single point on the seal moving surface will travel a greater distance and therefore the life of the seal will be reduced. Another disadvantage is that since the seals are located at the sides of the bearings, the width of the cutter cannot be reduced significantly without using smaller width bearings. In certain cases, a smaller width cutter is desirable.

Another common feature in drill bits for shaft boring and for earth boring in general, is the tendency to "track." "Tracking" is a condition which results when a cutter tooth repeatedly engages a previously made depression in a borehole bottom or face. As a result, a crest of rock may be generated on the face, which may lead to disadvantages such as erosion of the cutter shell or premature tooth disintegration. "Tooth" is used herein to include both tungsten carbide or other hard metal inserts secured in holes in the cutter exterior, and also steel teeth formed in the cutter exterior. As indicated in my prior U.S. Pat. No. 3,726,350, tracking is more difficult to avoid in types of cutters that approach true rolling. And true rolling contact is often advantageous to cutter life in rock drilling, especially in bits that utilize hard metal inserts.

One prior art method to avoid tracking is to dimension the cutter so that the ratio of the circumference described on the borehole face by a row of cutter teeth to the circumference of that row on the cutter does not equal an "integer." "Integer" is a whole (not fractional or mixed) number. Teeth arrangements to prevent tracking have also been utilized, such as shown in my above mentioned patent. Yet the problem still exists. For example, laboratory tests have indicated that a cutter may slip slightly and fall back into a previous depression. If the inserts are evenly spaced about the cutter, this slippage at one point may place the rest of the inserts back into the old pattern. Certain proposals have groups of inserts within a row separated from other groups. However, as far as known to applicant, the distance between the center lines of adjacent teeth in a circumferential row is uniform within all groups of inserts in the row.

SUMMARY OF THE INVENTION

It is the general object of this invention to provide an improved earth boring drill bit cutter assembly.

It is a further object of this invention to provide a drill bit cutter assembly for large diameter shaft drilling with improved bearing and seal arrangement, that reduces surface velocity on the seal without reducing the size of the bearings.

It is a further object of this invention to provide an earth boring drill bit with an improved cutter tooth arrangement that engages the borehole face in a non-tracking manner.

In accordance with these objects, a drill bit cutter is provided that has an axle with an enlarged central portion. Reduced portions of smaller diameter extend from both sides. The cutter sleeve is mounted on bearings on the central portion of the axle. Annular plates are secured to the sides of the cutter. Each plate has an axial bore through which a reduced portion extends. The seal seats between the reduced portion of the axle and the axial bore, preferably within a recess provided in each shoulder between the central portion and reduced portion. This results in a seal of smaller diameter than the bearings. The cutter width may also be reduced because a portion of each seal is located in the recess.

The cutter sleeve has a plurality of rows of hard metal inserts. The inserts within each row are identifiable in a number of groups. Within each group, the pitch varies, with the pitch gradually increasing in certain of the groups and gradually decreasing in other of the groups. Preferably a cycle is employed wherein two increasing groups are followed by two decreasing groups.

BRIEF DESCRIPTION OF THE DRAWINGS

FIG. 2 is a partial vertical sectional view of the drill reamer of FIG. 1, with the cutter assemblies shown rotated into the plane of the section, in phantom, to show their relative positions.

FIGS. 3 and 4 are discs that can be utilized in place of the cutters of FIG. 1, if desired.

DESCRIPTION OF THE PREFERRED EMBODIMENT

Figure 1:
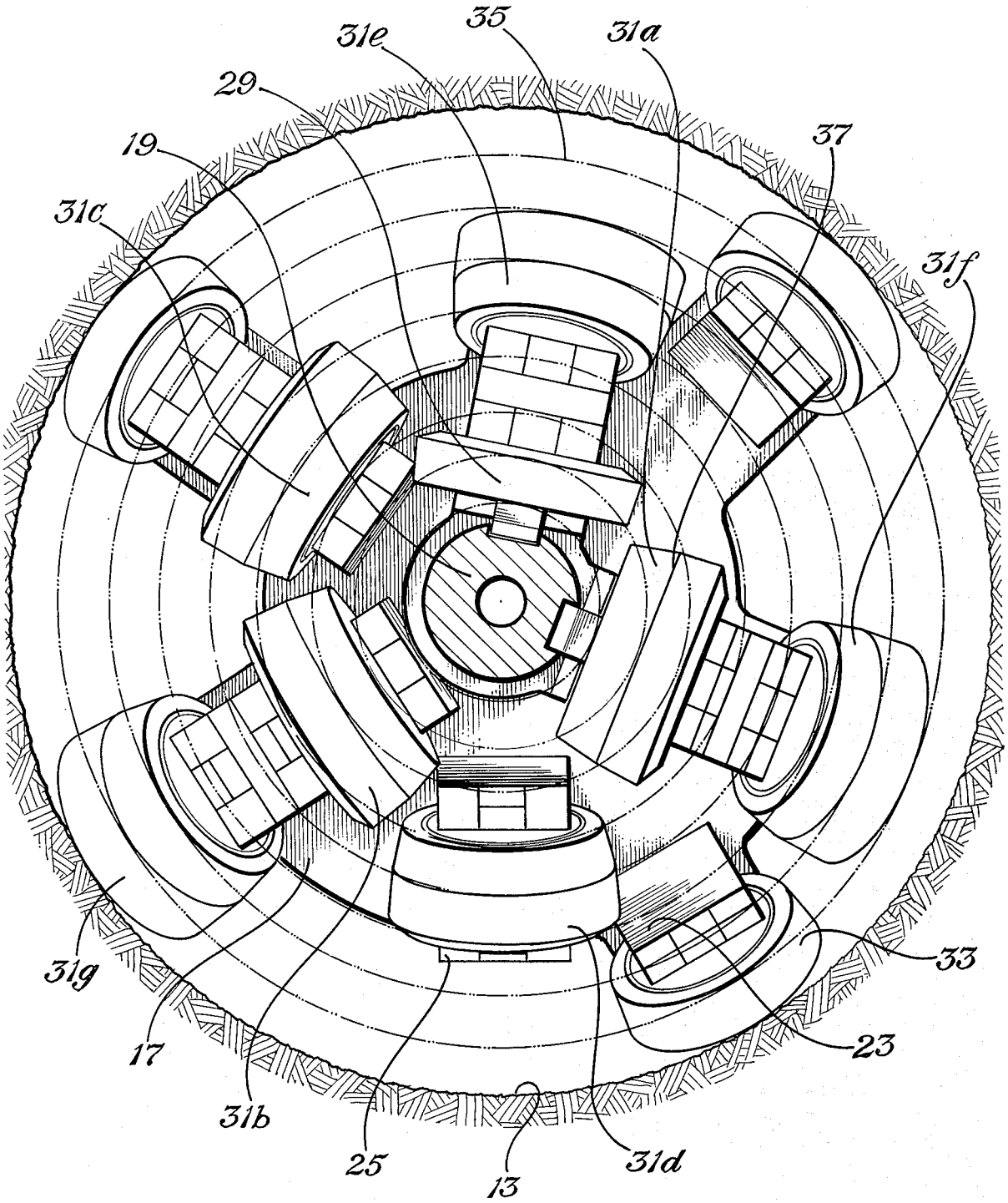
FIG. 1 is a top plan view of a raise drill reamer having cutter assemblies in accordance with this invention.

Referring to FIG. 2 a raise drill bit or reamer 11 is shown boring a shaft 13, it being drawn upward through a previously drilled pilot hole 15. Raise drill reamer 11 includes a cutter support member or plate 17 secured to a cylindrical stem 19 in the plate's axis of revolution and normal to the plate. Stem 19 is secured to drill pipe (not shown). A plurality of cutter assemblies 21 are mounted to the plate 17 but cutter mounts 23. Each cutter mount 23 has two arms 25 spaced apart from each other and facing away from the cutter support plate 17. Arms 25 define a saddle or cradle for receiving the cutter assembly 21. Each cutter assembly 21 is rotatable on its own axis, each axis lying generally in a vertical radial plane that contains the axis of rotation of cutter support plate 17, as can be seen in FIG. 1. Rotation of cutter support plate 17 by the drill pipe rotates the cutter assemblies 21 in annular paths to disintegrate the earth formation face 27. The term "borehole bottom," will be used interchangeably with the "earth formation face" although in raise drilling, the face 27 is actually the upper portion of shaft 13.

CUTTER ASSEMBLY PLACEMENT

Referring to FIG. 1, cutter assemblies 21 include an inner cutter 29, seven intermediate cutters 31, designated 31*a* through 31*g*, and three outer or gage cutters 33. The inner cutter 29 and the gage cutters 33 are approximately one-half the width of the intermediate cutters 31. The inner cutter 29 and gage cutters 33 have reinforcements on the inside cutting row and the outside or heel cutting row for cutting the pilot hole 15 (FIG. 2) and gage areas. The phantom lines 35 indicate the paths, or the annular areas of earth from the borehole bottom that the various cutters remove.

Figure 5:
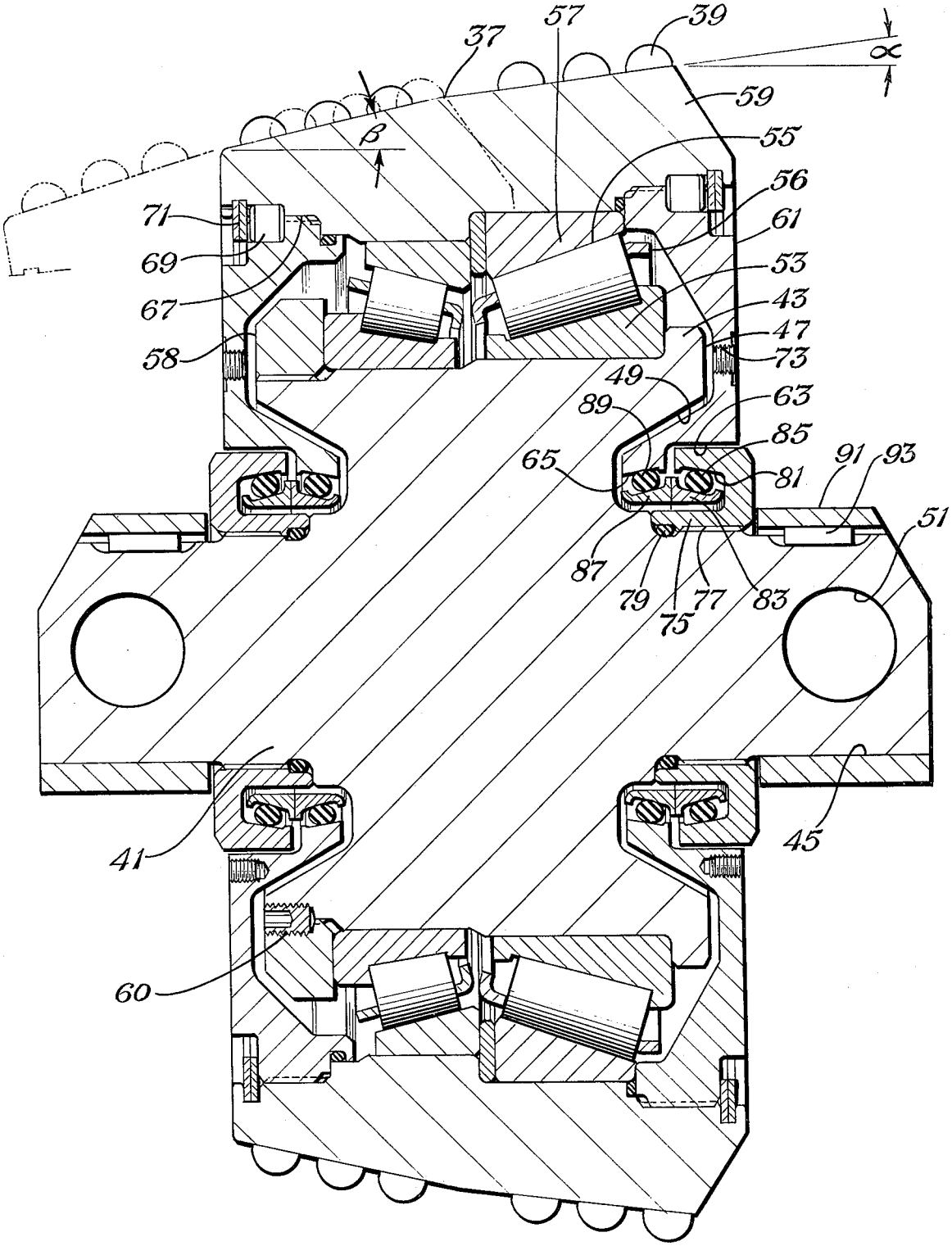
FIG. 5 is a vertical sectional view of one of the cutters of FIG. 1, with the next inward cutter shown partially in phantom and rotated into the plane of the section.

The inner cutter 29 is mounted adjacent the stem 19 for cutting the edge of the pilot hole 15 (FIG. 2). The innermost intermediate cutter 31*a* has its inner edge located the same distance from stem 19 as the inner edge of inner cutter 29. One half of intermediate cutter 31*a* overlaps the entire path of inner cutter 29. The next outward intermediate cutter 31*b* has its inner edge the same distance from the axis of revolution of the cutter support plate 17 as the midpoint 37 on the innermost intermediate cutter 31*a*. This causes the inner half of intermediate cutter 31*b* to fully overlap the outer half of intermediate cutter 31*a*. The outer edge of intermediate cutter 31*b* is the same distance from the center of the cutter support plate 17 as the midpoint 37 of intermediate cutter 31*c*. As shown in FIG. 5, "outer edge" refers to the outer edge of the heel row of inserts 39. The outer half or portion of intermediate cutter 31*c* fully overlaps with the inner half or portion of intermediate cutter 31*d*. The outer portion of intermediate cutter 31*d* fully overlaps with the inner portion of intermediate cutter 31*e*. The outer portion of intermediate cutter 31*e* fully overlaps with the inner portion of intermediate cutter 31*f*. The outer portion of intermediate cutter 31*f* fully overlaps with the inner portion of intermediate cutter 31*g*. The outer portion of intermediate cutter 31*g* fully overlaps the paths of the three gage cutters 33.

Referring to FIG. 5, midpoint 37 is also the location of an angle break between the inner and outer halves of each cutter assembly 21. Both the outer portion and the inner portion define frusto-conical surfaces that taper inwardly. The outer portion tapers at an angle $\alpha$ with respect to the axis of rotation of the cutter shell 59. The inner portion tapers inwardly at a greater angle $\beta$ with respect to the axis of rotation of the cutter shell 59. Preferably, the angle $\alpha$ is $7\frac{1}{2}$ degrees, while the angle $\beta$ is $12\frac{1}{2}$ degrees. Each portion cuts a plane surface. As shown in FIG. 2, the arms 25 of each cutter mount 23 are oriented to make a contour from the pilot hole 15 to the wall of shaft 13. Each path is a fursto-conical surface that inclines at a different angle, with respect to the plate 17, than adjacent paths, to create the contour. As shown by the phantom lines in FIG. 5, each intermediate cutter is oriented by its cutter mount so that the angle of inclination of its outer portion is approximately the same as the inner portion of the next outward cutter, with respect to cutter support plate 17.

As shown in FIG. 5, each cutter assembly 21 contains a plurality of rows of tungsten carbide inserts 39, which are interferingly secured in mating holes in the exterior of the cutter. The intermediate cutters 31 have three circumferential rows in the outer portion, and three circumferential rows in the inner portion. As will be explained hereinafter, the pattern of the inserts on the inner portion is preferably distinctly different from the pattern of the inserts on the outer portion. Also, as shown by the phantom lines in FIG. 5, the cutter mounts 23 are laterally offset one-half insert width. This causes the rows of inserts of an overlapping cutter to contact the earth face in the spaces between where the rows of inserts of the overlapped cutter contact. This pairing of cutters so that their rows contact different portions of the earth face results in close spacing of depressions on the earth face.

FIG. 3 illustrates a disc cutter 93 of the same width as the intermediate cutters 31, and for interchanging on the cutter mounts 23 for the intermediate cutters 31. FIG. 4 discloses a disc cutter 95 of the same width as the inner cutter 29 and the gage cutters 33, and for interchanging on the cutter mounts 23 for the inner and gage cutters. Both disc cutters 93 and 95 have smooth circumferential surfaces except for a single ridge 97 for disintegrating the earth formation face. Ridge 97 is in the center of cutter 93. Cutter 95 can be reversed so that ridge 97 will be located on the outer edge for the gage and on the inner edge for the cutter adjacent the pilot hole, as shown in FIG. 8.

Figure 8:
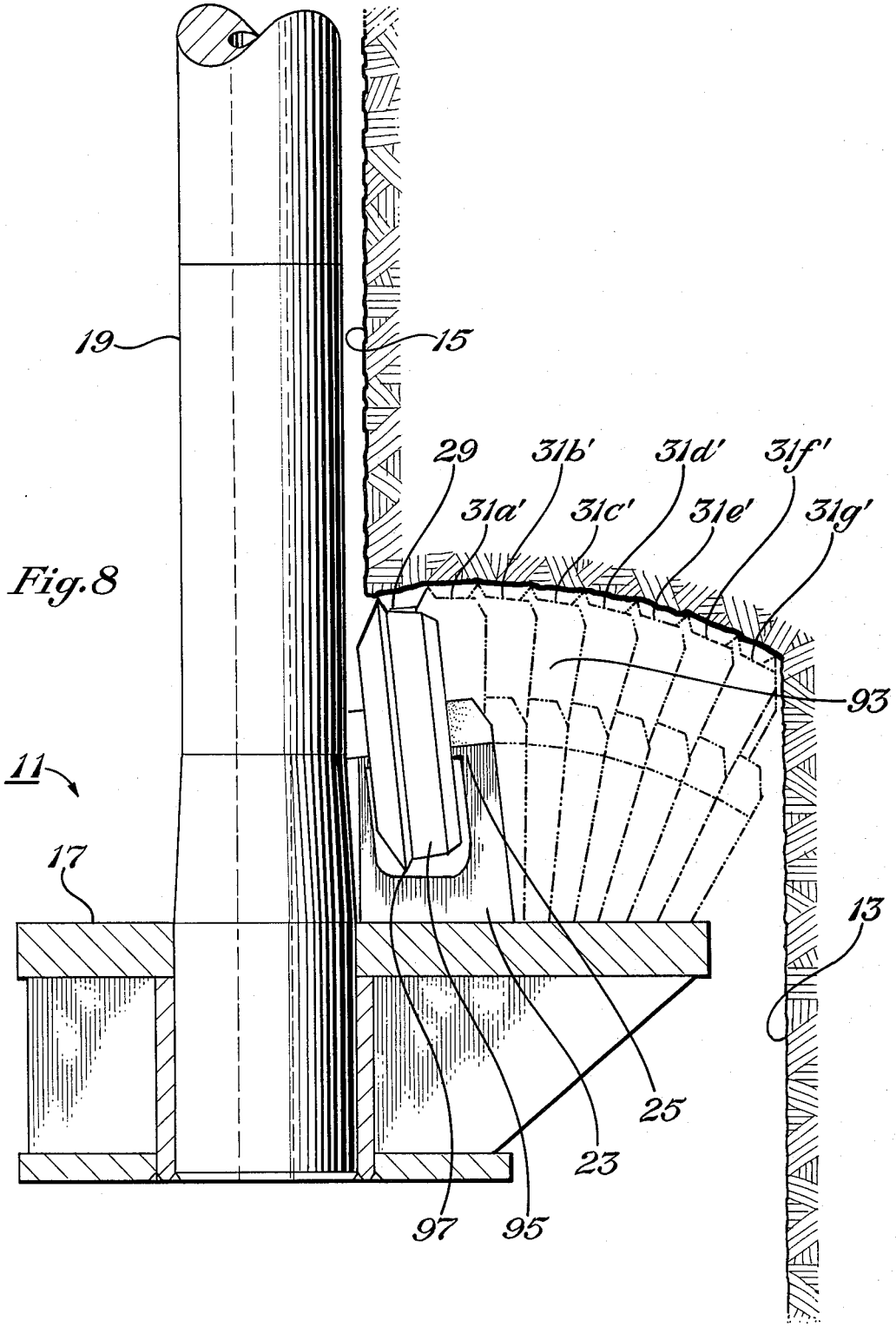
FIG. 8 is a view of the drill reamer of FIG. 1 similar to the view shown in FIG. 2, but with the disc cutters of FIGS. 3 and 4 mounted to the bit body rather than toothed cutters.

If the intermediate cutters 31 cover two three inch paths, the paths of the ridges 97 will be only three inches apart because of the overlapping as shown by FIG. 8, and by reference to FIG. 1. For example, the ridge 97 for cutter 31*c* is only one-half cutter's width further outward than the ridge 97 for cutter 31*b*. Without the overlapping arrangement shown in FIG. 1, two discs would have to be placed on a six inch cutter in order to achieve three inch spacing. This allows the same bit body to be used both for cutters having earth disintegrating teeth and for disc cutters.

BEARING AND SEAL ARRANGEMENT

Referring again to FIG. 5, each cutter assembly 21 includes an axle 41. Axle 41 has a generally cylindrical enlarged central portion 43 and reduced cylindrical portions 45 on both sides. Shoulder 47 separates the enlarged portion 43 from the reduced portions 45. A recess 49 is formed in the shoulder 47. Recess 49 has an inner diameter slightly greater than the diameter of the reduced portion 45, and an outer diameter about three-fourths the smallest diameter of the central portion 43. Reduced portions 45 both contain passages 51 for connection to the arms 25 of the cutter mounts 23.

Two inner bearing races 53 are fitted over the central portion 43 of axle 41. The larger inner bearing race is on the outer side of cutter assembly 21. A plurality of tapered roller bearings 55 are carried on the outer surface of inner race 53, retained by a cage 56 and outer race 57. A cutter shell or sleeve 59 fits tightly over the two outer races 57. Threaded ring 58 secures and preloads the bearing assemblies, with set screw 60 preventing rotation once ring 58 is tightened. The outer races 57, cage 56, rollers 55, and inner races 53 serve as bearing means for rotatably supporting the cutter shell 59 for rotation with respect to axle 41. Axle 41 serves as axle means for rotatably carrying cutter shell 59. An annular member 61 is rigidly secured to cutter shell 59 for rotation therewith. Annular member 61 has an axial bore 63 through which a reduced portion 45 protrudes. Annular member 61 has a smooth outer face flush with the sides of cutter shell 59, and a concave interior face, that has a portion extending into recess 49. Axial bore 63 has a seal seat 65 formed on it within the portion that fits in recess 49. Each annular member 61 is secured to cutter shell 59 by threads 67, backed up by a dowel pin 69 and retainer ring 71. Each annular member 61 also has a threaded socket 73 for securing a tool for assembling.

Seal means is mounted between each reduced portion 45 and each seal seat 65 for preventing the ingress of grit into the bearing means. The preferred seal means is of the type known as "Caterpillar" seal and is shown in U.S. Pat. No. 3,612,196. The seal means includes a seal cage 75 secured by threads 77 to a reduced portion 45. An O ring 79 prevents ingress of fluids through the threads. Seal cage 75 is an annular channel member, with the channel 81 facing toward the interior. A fixed seal ring 83 fits inside channel 81, compressing a resilient O ring 85 between it and the channel 81. Seal ring 83 is metallic and has a metallic face facing toward the interior. A rotating seal ring 87 is located within the recess 49, compressing a resilient O ring 89 between it and seal seat 65. Rotating seal ring 87 rotates with cutter shell 59, with its face in sliding contact with the face of the fixed seal ring 83. A square sleeve 91 is secured over each reduced portion 45 by a key 93, for mounting within arms 25.

As is apparent in the figure, the diameter of the seal means is considerably less than the diameter of the axle central portion 43 and inner diameter of either inner bearing race 53. In the preferred embodiment, the outer diameter of the metallic faces of seal rings 83 and 87 is about $4\frac{5}{8}$ inch, while the inner diameter of the smaller bearing race 53 is about $7\frac{5}{8}$ inch. This allows a large diameter bearing, with a seal means of smaller diameter to reduce surface velocity and heat. Also, the recess 49 accomodates more than half of the width of the seal means, allowing a reduced overall cutter width. In the preferred embodiment, the seal means is about $1\frac{5}{8}$ inch wide, and about $1\frac{1}{8}$ inch of it is received within recess 49. Also, the distance between the seal means on one side to the seal means on the other side is less than the width of the two inner bearing races 53.

Insert Placement

Figure 7:
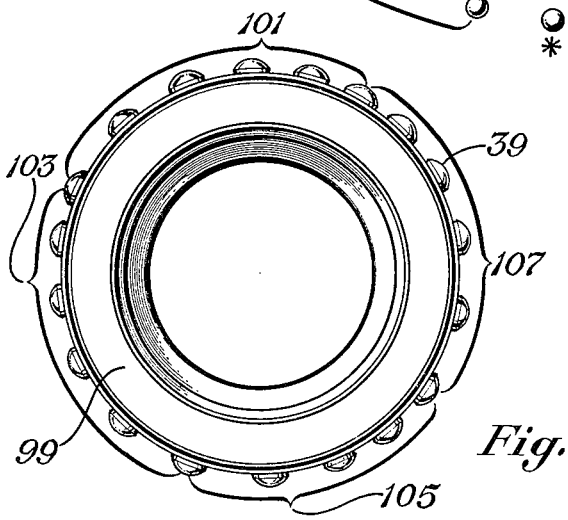
FIG. 7 is an end view of a cutter illustrating the principle of the insert spacing shown in the layout of FIG. 6.

Referring to FIG. 7, a side elevational view of a cutter shell 99 is shown with a single row of inserts 39. Cutter shell 99 illustrates both a cutter for a shaft drill bit as shown in the other figures, and a cutter for a three cone bit such as is shown in U.S. Pat. No. 3,727,705. Inserts 39 are grouped into four separate groups, indicated as 101, 103, 105, and 107. Within each group, the pitch varies. The pitch is defined herein as the distance between the centerlines of adjacent inserts of a circumferencial row, measured generally between the intersections of the centerlines with the surface of the cutter shell that supports the inserts. In group 101, the pitch gradually increases in a counterclockwise direction. Group 103 is identical to group 101, the pitch gradually increasing. Group 105 immediately follows group 103 and has decreasing pitch. Group 107 immediately follows group 105 and has decreasing pitch.

The amount of increase in pitch, decrease in pitch and the number in each group are selected according to several criteria. First, there is a minimum pitch determined by the necessary cutter shell metal needed to hold the insert in place. The maximum amount of pitch is determined by the extent a typical earth formation is disturbed by a single insert. This normally will be somewhat greater than the diameter of the insert 39 and depends also on the cutter circumference and amount the insert protrudes from the cutter shell exterior.

The number of inserts within the group depends upon the desired change from insert to insert. To have an appreciable difference between the pitch from one insert to its adjacent inserts, generally groups from about three to seven inserts are used. To calculate the precise position, the number of spaces between inserts in the group, less one, is divided into the total increase in pitch. This constant number is allotted to each space between inserts in the group. Consequently, in an increasing group, any space between insert centerlines will be the same as the preceding space in the group plus the constant number. In a decreasing group, any space between insert centerlines will be the same as the preceding space less the constant number. Preferably the same maximum and minimum are used for each group within a single row.

Figure 6:
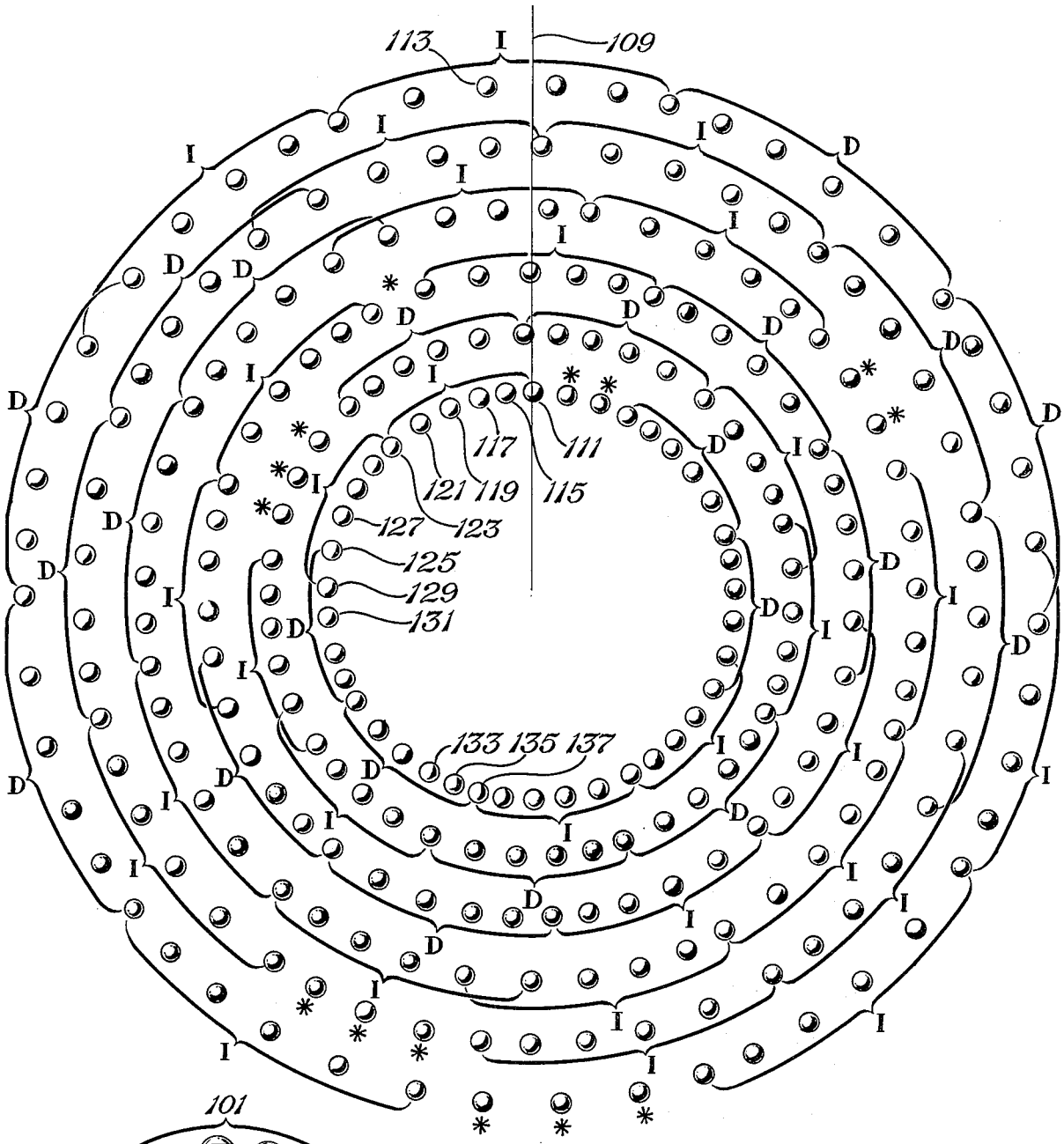
FIG. 6 is a schematic layout, showing a preferred insert spacing arrangement for the cutter of FIG. 1.

By way of example, FIG. 6 illustrates spacing for the six rows of the cutter shown in FIG. 5. "Spacing" of inserts relates to the angular measure between teeth. All of the inserts within a single row are at the same distance from the edge of the cutter. The smallest diameter row, as shown in FIG. 6, is the innermost row, which is the one shown on the left in FIG. 5. The largest diameter row shown in FIG. 6 is the outermost row or the one on the right, as shown in FIG. 5. The diameter of the cutter shell 59 does not vary as much as the relative diameters between row 1 and row 6 as shown in the spacing diagram of FIG. 6. However, the particular angle at which one of the inserts lies, with respect to the reference line 109, will be the actual point where the insert is placed in the cutter shell 59. For example, in row 1, the first insert 111 is shown at zero degrees. The insert 113 of row 6 is shown at about five degrees, and on the cutter shell 59, insert 113 will be five degrees, rotationally, from insert 111.

As shown by the bracket indicators in FIG. 6, each row is divided into eight or more groups, with the groups marked "I" having increasing pitch and the groups marked "D" having decreasing pitch, as viewed counterclockwise. The inserts marked with an asterisk are inserts for filling the space between the first group in a row and the last full group. The pitch in the leftover group preferably varies also, generally increasing or decreasing according to what would normally occur in the cycle.

Each group, except the leftover group, contains six inserts, yielding five spaces between inserts for varying. For example, if the minimum pitch selected is 0.875 inch for row 1, and a maximum pitch selected is 1.337 inch, the difference between the two is 0.462 inch. Divided by four spaces, this yields a constant number of about 0.115 inch for each space between centerlines. The distance between the centerlines of insert 111 and insert 115 at the intersection with the cutter shell is 0.875 inch, which transcribes to about seven degrees from reference 109. Between the centerlines of insert 115 and insert 117, the distance is the sum of 0.875 inch plus 0.115, yielding 0.990 inch. This places insert 117 slightly more than 15 degrees from the reference 109. Between the centerlines of insert 117 and insert 119, the distance is 0.990 inch plus 0.115 equalling 1.105 inch, and placing insert 119 at about 23 degrees. Between the centerlines of insert 119 to insert 121, the distance is 1.105 plus 0.115, equalling 1.220 inch, and placing insert 121 at about 33 degrees. Between the centerlines of insert 121 and insert 123, the distance is 1.220 plus 0.115 inch, equally 1.335, and placing insert 123, at about 44 degrees. The other increasing groups are calculated exactly in the same manner.

Insert 123 is the first insert in the second group, as well as the last insert in the first group. The first insert 125 in the first decreasing group is also the fifth insert in the second increasing group. The distance to the preceeding insert 127 centerline is 1.220 inch and to the succeeding insert 129 centerline is 1.335 inch. The distance from the centerline of insert 129 to the centerline of the next insert 131 is 1.335 minus 0.115 inch or 1.220 inch. The decreasing groups are calculated in reverse to the increasing groups. The reason that a decreasing row overlaps one insert with an increasing row, when following it, is to avoid having two maximum pitches next to each other. When cycling from the second decreasing group to the first increasing group, overlapping can be avoided since the pitch is at a minimum. For example, the distance from the centerlines of insert 133 and insert 135 is the minimum of 0.875 inch for the last insert of a decreasing group. The distance from the centerlines of inserts 135 and 137 is also 0.875 inch, for the first of an increasing group. Insert 135 is the only insert of row 1 that has the same pitch on one side as on the other side.

The other rows are calculated in the same manner, except since the cutter shell circumference is larger, the maximum and minimum pitches may be different. Also, the groups are not started at the same point. In the preferred embodiment, row 2 commences the same pattern as row 1, but at 82 degrees; row 3 commences the same pattern as row 1 at 29 degrees; row 4 commences the same type of pattern as row 1 at 312 degrees; row 5 commences the same type of pattern as row 1 at 174 degrees; and row 6 commences the same type of pattern as row 1 at 200 degrees, all with reference to the line 109. Consequently, the pattern of the rows of inserts on the inner three rows of a cutter assembly 21 will be distinctly different from the spacing of the three rows on the outer portion of the cutter assembly 21.

It should be apparent that an invention having significant advantages has been provided. By overlapping and providing two distinctly different cutting arrangements on each half of the intermediate cutters, tracking can be reduced. The overlapping and angle breaks reduce ridge buildup between paths. Expensive reinforcements necessary for gage and pilot hole cutting can be placed only on the shorter width cutters. Gage cutters, on which only the heel row inserts are damaged, can be re-used next to the pilot hole. If higher unit loads are desirable to increase penetration rate and reduce cutter costs, alternate cutters can be removed without sacrificing borehole coverage. The overlapping makes it possible to provide single disc cutters on a three inch spacing with a bit body for six inch spacing tooth cutters.

While the invention has been shown in only one of its forms, it should be apparent to those skilled in the art that it is not so limited, but is susceptible to various changes and modifications without departing from the spirit thereof.

I claim:

1. A rotatable cutter for earth boring equipment comprising:

an axle having an enlarged central portion and reduced portions on both sides of lesser diameter than the central portion;

a cutter sleeve rotatably mounted on the central portion; and seal means between the reduced portions and the cutter sleeve for preventing ingress of grit.

2. A rotatable cutter for earth boring equipment comprising:

an axle having an enlarged central portion and reduced portions on both sides of lesser diameter than the central portion;

the sides of the central portion having an annular recess;

a cutter sleeve rotatably mounted on the central portion; and seal means between the reduced portions and the cutter sleeve for preventing ingress of grit, each seal means being located at least partially in one of the recesses.

3. An improved drill bit cutter assembly for earth boring, comprising in combination:

an axle means for rotatably carrying a cutter sleeve and having an enlarged central portion with reduced portions on both sides of lesser diameter than the central portion, for securing to a cutter mount;

the cutter sleeve being rotatably carried by the central portion of the axle means, with the reduced portions of the axle means extending beyond each side of the cutter sleeve;

bearing means, located between the cutter sleeve and the central portion of the axle means, for supporting the cutter sleeve for rotation with respect to the axle means;

an annular member extending inwardly from each edge of the cutter sleeve for rotation therewith, the annular member having a central bore therein, the bore being of lesser diameter than the central portion of the axle means; and seal means mounted between each reduced portion of the axle means and each bore for preventing the ingress of grit into the bearing means.

4. An improved drill bit assembly for earth boring, comprising in combination:

an axle having an enlarged central portion with reduced portions on both sides of lesser diameter than the central portion, for securing to a cutter mount;

a cutter sleeve rotatably carried by the central portion of the axle, with the reduced portions of the axle extending beyond each side of the cutter sleeve;

bearing means located between the cutter sleeve and a central portion of the axle for supporting the cutter sleeve for rotation with respect to the axle; the bearing means including an inner race in contact with the central portion of the axle, an outer race carried by the cutter sleeve, and roller bearings therebetween;

an annular member extending inwardly from each edge of the cutter sleeve for rotation therewith and having an axial bore therein; and seal means mounted between each bore and each reduced portion of the axle for preventing the ingress of grit into the bearing means, the seal means including a metal face seal with an outer diameter less than the inner diameter of the inner bearing race.

5. An improved drill bit assembly for earth boring, comprising in combination:

an axle having an enlarged central portion with reduced portions on both sides of lesser diameter than the central portion, for securing to a cutter mount;

a cutter sleeve rotatably carried by the central portion of the axle, with the reduced portions of the axle extending beyond each side of the cutter sleeve;

bearing means located between the cutter sleeve and a central portion of the axle for supporting the cutter sleeve for rotation with respect to the axle; the bearing means including an inner race in contact with the central portion of the axle, an outer race in contact with the cutter sleeve, and roller bearings therebetween;

an annular member extending inwardly from each edge of the cutter sleeve for rotation therewith and having an axial bore therein; and seal means mounted between each axial bore and each reduced portion of the axle for preventing the ingress of grit into the bearing means; the seal means including a seal cage fixed to each reduced portion of the axle, a fixed seal ring disposed within the seal cage and having a metallic seal face, a compressed, resilient ring disposed between the fixed seal ring and the seal cage, a rotary seal ring disposed within the axial bore and having a metallic seal face in sliding contact with the face of the fixed seal ring, and a compressed resilient ring disposed between the axial bore and the rotary seal ring; the outer diameter of the metallic seal faces being less than the diameter of the inner race.

6. An improved drill bit cutter assembly for earth boring, comprising in combination:

an axle having an enlarged central portion and reduced portions on both sides of the central portion, for securing to a cutter mount; the reduced portions being of smaller diameter than the central portion, defining a shoulder on each side of the central portion;

each shoulder having an annular recess formed thereon;

a cutter sleeve rotatably carried by the central portion of the axle, with the reduced portions of the axle extending beyond each side of the cutter sleeve;

bearing means, located between the cutter sleeve and the central portion of the axle, for supporting the cutter sleeve for rotation with respect to the axle;

an annular member extending inwardly from each edge of the cutter sleeve for rotation therewith, each annular member having an axial bore with a portion of the annular member adjacent the axial bore extending into the recess in each shoulder of the axle; and seal means disposed between each axial bore and each reduced portion of the axle for preventing the ingress of grit into the bearing means.

7. An improved drill bit cutter assembly for earth boring, comprising in combination:

an axle having an enlarged central portion with reduced portions on both sides of the central portion, for securing to a cutter mount; the reduced portions being of smaller diameter than any part of the central portion, defining a shoulder on each side of the central portion;

each shoulder having an annular recess formed therein;

a cutter sleeve rotatably carried by the central portion of the axle, with the reduced portions of the axle extending beyond each side of the cutter sleeve;

bearing means located between the cutter sleeve and the central portion of the axle for supporting the cutter sleeve for rotation with respect to the axle; the bearing means including an inner race in contact with the central portion of the axle, an outer race in contact with the cutter sleeve, and roller bearings disposed therebetween;

an annular member extending inwardly from each edge of the cutter sleeve for rotation therewith, each annular member having an axial bore with a seal seat formed therein, the seal seat extending into the recess of the shoulder of the axle; and seal means disposed between the seal seat and each reduced portion of the axle for preventing the ingress of grit into the bearing means, the seal means including a seal cage fixed to each reduced portion of the axle, a fixed seal ring disposed within the seal cage and having a metallic face, a compressed, resilient ring disposed between the fixed seal ring and the seal cage, a rotary seal ring disposed within the seal seat and having a metallic seal face in sliding contact with the face of the fixed seal ring, and a compressed reslient ring disposed between the seal seat and the rotary seal ring; the rotary seal ring being located within the recess in the shoulder of the axle.

8. In an earth boring drill bit of the type having a cutter support member adapted to be carried by a string of drill pipe normal to its rotational axis, and a plurality of cutter assemblies mounted on cutter mounts secured to the cutter support member, the improvement comprising:

an axle having an enlarged central portion, with reduced portions on both sides of the central portion, for securing to one of the cutter mounts, the reduced portions being of smaller diameter than any part of the central portion, defining a shoulder on each side of the central portion;

each shoulder having an annular recess formed therein;

a cutter sleeve, having cutting elements on its exterior, carried by the central portion of the axle, with the reduced portions of the axle extending beyond each side of the cutter sleeve;

bearing means located between the cutter sleeve and central portion of the axle for supporting the cutter sleeve for rotation with respect to the axle; the bearing means including a pair of inner races in contact with the central portion of the axle, a pair of outer races in contact with the cutter sleeve, and roller bearings located between the inner and outer races;

an annular member extending inwardly from each edge of the cutter sleeve for rotation therewith, each annular member having an axial bore formed therein, the exterior face of each annular member being substantially flush with the edges of the cutter sleeve, a portion of the interior face of each annular member extending into the recess;

seal means disposed between the axial bore and the reduced portion of each axle for preventing the ingress of grit into the bearing means, the seal means including a seal cage fixed to each reduced portion of the axle, a fixed seal ring disposed within the seal cage and having a metallic face, a compressed, resilient ring disposed between the fixed seal ring and the seal cage, a rotary seal ring disposed within the axial bore and having a metallic seal face in sliding contact with the face of the fixed seal ring, and a compressed, resilient ring disposed between the axial bore and the rotary seal ring; each rotary seal ring being located within the recess, the distance from the rotary seal ring on one side of the cutter assembly to the rotary seal ring on the other side of the cutter assembly being less than the width of the two inner bearing races, in assembled position.

9. An improved drill bit cutter assembly for earth boring, comprising in combination:

an axle having an enlarged central portion with reduced portions on both sides of lesser diameter than the central portion, for securing to a cutter mount;

a cutter sleeve rotatably carried by the central portion of the axle, with the reduced portions of the axle extending beyond each side of the cutter sleeve, the cutter sleeve having a plurality of circumferential rows of hard metal inserts secured in holes within it for disintegrating the earth, substantially all of the inserts within at least one of the rows being identical, and identifiable in groups wherein the pitch between the inserts within each group varies, bearing means, located within the cutter sleeve and the central portion of the axle, for supporting the cutter sleeve for rotation with respect to the axle;

an annular member extending inwardly from each edge of the cutter sleeve for rotation therewith, the annular member having an axial bore therein of less diameter than the central portion of the axle; and seal means mounted between each reduced portion of the axle and each axial bore, for preventing the ingress of grit into the bearing means.

10. An improved drill bit cutter assembly for earth boring, comprising in combination:

an axle having an enlarged central portion with reduced portions on both sides of lesser diameter than the central portion, for securing to a cutter mount;

a cutter sleeve rotatably carried by the central portion of the axle, with the reduced portions of the axle extending beyond each side of the cutter sleeve; the cutter sleeve having a plurality of circumferential rows of hard metal inserts secured in holes within it for disintegrating the earth, substantially all of the inserts within at least one of the rows being identifiable in groups, the pitch within certain of the groups increasing, the pitch within other groups decreasing;

bearing means, located between the cutter sleeve and the central portion of the axle, for supporting the cutter sleeve for rotation with respect to the axle;

an annular member extending inwardly from each edge of the cutter sleeve for rotation therewith, the annular member having an axial bore therein of less diameter than the central portion; and seal means mounted between each reduced portion of the axle and each axial bore for preventing the ingress of grit into the bearing means.

11. A rotatable cutter for an earth boring drill bit having a plurality of circumferential rows of hard metal inserts secured in holes in the cutter for disintegrating the earth, substantially all of the inserts within at least one of the rows being identifiable in groups of increasing pitch and groups of decreasing pitch, each group having at least five inserts.

12. A rotatable cutter for an earth boring drill bit having a plurality of circumferential rows of hard metal inserts secured in holes in the cutter for disintegrating the earth, substantially all of the inserts within at least one of the rows being identifiable in groups, each group having at least five inserts; the pitch, beginning with a selected minimum, increasing gradually to a selected maximum within certain of the groups; the pitch, beginning with the selected maximum, gradually decreasing to the selected minimum within the remaining groups, to reduce tracking.

13. A rotatable cutter for an earth boring drill bit having a plurality of circumferential rows of hard metal inserts secured in holes in the cutter for disintegrating the earth, substantially all of the inserts of at least one of the rows being identifiable in groups of at least five inserts, each group having a minimum pitch and a maximum pitch that is substantially the same for all of the other groups in that row, the pitch within approximately one-half of the groups uniformly increasing, the pitch within the other half of the groups uniformly decreasing.

14. A rotatable cutter for an earth boring drill bit having a plurality of circumferential rows of hard metal inserts secured in holes in the cutter for disintegrating the earth, substantially all of the inserts within at least one of the rows being identifiable in groups, each group having three to seven inserts, certain of the groups having incrementally increasing pitch and other of the groups having incrementally decreasing pitch, the groups being arranged so that at least two of the increasing groups are located together and followed immediately by an equal number of decreasing groups, in cycles.

15. In an earth boring drill bit of the type having a cutter support member adapted to be secured to a string of drill pipe normal to the rotational axis of the cutter support member and a plurality of cutters mounted on axles, each axle having two ends extending past the cutter and connected to a cutter mount which is secured to the cutter support member, the cutters having a plurality of circumferential rows of hard metal inserts secured in holes in the cutter exterior, an improved insert placement comprising:

substantially all of the inserts within at least one of the rows being identifiable in at least four groups, each group having from three to seven inserts, each group having a minimum pitch and a maximum pitch that is substantially the same for all of the other groups in that row, the pitch within two of the groups gradually increasing, and the pitch within two other groups gradually decreasing, the groups being located so that two groups of increasing pitch are followed by two groups of decreasing pitch, the inserts within the row being identical in configuration.

16. In an earth boring drill bit of the type having a cutter support member adapted to be connected to a string of drill pipe normal to the rotational axis of the cutter support member, and a plurality of cutters mounted on axles, each axle having two ends extending past the cutter and connected to a cutter mount which is secured to the cutter support member, the cutters having a plurality of circumferential rows of hard metal inserts secured in holes in the cutter exterior, an improved insert placement comprising:

substantially all of the inserts within at least one of the rows being identifiable into at least four distinct groups, each group having from three to seven inserts, each group having a minimum distance between any two inserts and a maximum distance between any two inserts, the minimum and the maximum distances being substantially the same for all of the groups in a single row, the number of inserts in each group being substantially the same, the distance between inserts in certain of the groups increasing and in other groups decreasing, the distance between any two insert centerlines within an increasing group being the distance from the preceding insert centerline in that group plus a substantially constant number, the distance between any two insert centerlines within a decreasing group being the distance to the preceding insert centerline in that group less the same substantially constant number, the groups being arranged so that two increasing groups follow two decreasing groups, in a cycle.

17. A rotatable cutter for an earth boring drill bit having a plurality of circumferential rows of hard metals inserts secured in holes in the cutter for disintegrating the earth, substantially all of the inserts in at least one of the rows being identifiable in groups of at least five inserts, the spacing between adjacent inserts in at least one of the groups increasing by a constant amount from a selected minimum to a selected maximum, the spacing between adjacent inserts in at least one other of the groups decreasing by a constant amount from a selected maximum to a selected minimum.

18. A rotatable cutter for an earth boring drill bit having a plurality of rows of hard inserts secured in holes in the cutter for disintegrating the earth, substantially all of the inserts in at least one of the rows being identifiable in groups of increasing pitch and groups of decreasing pitch, each group having minimum and maximum spacings between adjacent inserts that are substantially the same for all of the groups, the spacing between adjacent inserts in the groups of increasing pitch increasing by a constant amount from one insert to the next, the spacing between adjacent inserts in the groups of decreasing pitch decreasing by the same constant amount from one insert to the next.

* * * * *

UNITED STATES PATENT AND TRADEMARK OFFICE

CERTIFICATE OF CORRECTION

PATENT NO. : 4,316,515

DATED : February 23, 1982

INVENTOR(S) : Rudolf C. O. Pessier

It is certified that error appears in the above—identified patent and that said Letters Patent is hereby corrected as shown below:

On the Title page Item [75] , Inventor's name "Rudolph" should read --Rudolf--.
Column 3, line 6, "but" should read --by--.

Signed and Sealed this

*Thirteenth* Day of *July 1982*

[SEAL]

*Attest:*

GERALD J. MOSSINGHOFF

*Attesting Officer*

*Commissioner of Patents and Trademarks*